US007819402B2

(12) United States Patent
Witz

(10) Patent No.: US 7,819,402 B2
(45) Date of Patent: Oct. 26, 2010

(54) DICE GAME FOR WAGERING

(75) Inventor: Steven Witz, Clarendon Hills, IL (US)

(73) Assignee: Listerik Products, Inc., Clarendon Hills, IL (US)

( * ) Notice: Subject to any disclaimer, the term of this patent is extended or adjusted under 35 U.S.C. 154(b) by 59 days.

(21) Appl. No.: 12/315,675

(22) Filed: Dec. 5, 2008

(65) Prior Publication Data

US 2009/0146372 A1 Jun. 11, 2009

Related U.S. Application Data

(60) Provisional application No. 61/005,396, filed on Dec. 5, 2007.

(51) Int. Cl.
*A63F 9/04* (2006.01)

(52) U.S. Cl. ..... 273/146

(58) Field of Classification Search ..... 273/146
See application file for complete search history.

(56) References Cited

U.S. PATENT DOCUMENTS 5,487,547 A * 1/1996 Hobert ..... 273/274
5,490,670 A * 2/1996 Hobert ..... 463/20
5,775,696 A * 7/1998 Sidlow et al. ..... 273/274
5,785,596 A * 7/1998 Hobert ..... 463/22
5,806,847 A 9/1998 White et al.
5,909,874 A 6/1999 Daniel et al.
6,120,377 A 9/2000 McGinnis, Sr. et al.
6,123,333 A 9/2000 McGinnis, Sr. et al.
6,123,335 A * 9/2000 Adkins ..... 273/292
6,173,955 B1 * 1/2001 Perrie et al. ..... 273/146
6,176,489 B1 1/2001 Astaneha
6,364,314 B1 * 4/2002 Canterbury ..... 273/274
6,378,869 B1 4/2002 Hedge, Jr. et al.
6,601,848 B1 8/2003 Timmons, Sr.
6,802,508 B2 10/2004 Moody
6,805,352 B2 * 10/2004 Hunter ..... 273/274
6,913,262 B2 * 7/2005 Berman ..... 273/292
6,974,132 B2 12/2005 Sorge
7,036,817 B2 5/2006 Oliva
7,434,808 B2 10/2008 Sorge

OTHER PUBLICATIONS

Scarne's Enclycopedia of Games, John Scarne, 1973, Harper & Row, pp. 319-321.*

* cited by examiner

*Primary Examiner*—Alvin A Hunter
*Assistant Examiner*—Dolores Collins
(74) *Attorney, Agent, or Firm*—Howard & Howard Attorneys PLLC

(57) ABSTRACT

A dice game, playable on a table at a casino or on a computer, kiosk, or machine, utilizes a pair of twenty-sided dice. The dice are rolled in an initial roll and the values shown on the dice are summed together to provide an initial roll value. If the initial roll value is a 19, 20, or 21, then a payout is made on a wager. If the initial roll value is 2-18 or 22-40, then that number is set as the point. Play is limited to four subsequent rolls in which the goal is to re-roll the point before rolling a twenty. If the point is rolled during the subsequent rolls, then a payout is made on the wager. Furthermore, a payout on the wager is also made if a 19 or 21 is rolled during the subsequent rolls.

22 Claims, 4 Drawing Sheets

| | | | | |
|---|---|---|---|---|
| 29 | 6 | 21 | 32 | 3 |
| 10 | 28 | 4 | 20 | |
| 7 | 12 | 30 | 16 | 11 |
| 15 | 5 | 39 | 7 | 19 |
| 9 | 32 | 19 | 8 | 19 |
| 11 | 27 | 24 | 11 | |
| 21 | | | | |
| 26 | 7 | 2 | 31 | 22 |
| 36 | 31 | 24 | 17 | 13 |
| 31 | 5 | 31 | | |
| 23 | 25 | 16 | 11 | 28 |
| 16 | 21 | 10 | 19 | 21 |
| 20 | | | | |
| 33 | 24 | 20 | | |
| 22 | 39 | 9 | 18 | 22 |

DICE GAME FOR WAGERING

CROSS REFERENCE TO RELATED APPLICATION

This application claims the benefit of provisional patent application No. 61/005,396 filed Dec. 5, 2007, which is hereby incorporated by reference.

FIELD OF THE INVENTION

The subject invention relates to a wagering game. Specifically, the subject invention relates to a wagering game that is played with dice on a table or simulated dice on a computer, slot machine, or electronic kiosk.

DESCRIPTION OF THE RELATED ART

Dice games, i.e., games where the result of a wager is determined by the roll of dice, have long been a popular pastime and form of entertainment. One particular dice game, Craps, is commonly featured in a vast number of casinos. Craps is traditionally one of the more popular casino games and occasionally invokes hoots, hollers, and applause from its participants.

Craps is based on two primary bets: the pass line bet and the odds bet. Craps involves an initial roll of two six-sided dice. If the initial roll produces a 7 or an 11, then a payout occurs for any pass line bet. If the initial roll produces a 4, 5, 6, 8, 9, or 10, then the value of the initial roll is set as the point or target value. Subsequent rolls continue indefinitely until either the point is rolled or a 7 is rolled. If the point is rolled then a payout occurs for any pass line bet and any odds bet. If a 7 is rolled, then all pass line and odds bets are surrendered. The payouts for pass line bets are typically 1:1 and the payouts for odds bets are typically 6:5, 3:2, or 2:1 based on the number that is set as the point.

Despite the popularity of Craps, the indefinite number of subsequent rolls can often make the game feel tedious, especially for a player who is not engaging in one of the various proposition bets that are often available on a Craps table. Furthermore, the payouts for pass line and odds bets are typically limited to no more than 2:1. Therefore, there remains an opportunity for a dice game that provides a high level of continuous excitement and the potential for larger payouts made on the primary bet.

SUMMARY OF THE INVENTION AND ADVANTAGES

One aspect of the subject invention discloses a method of playing a dice game for wagering by at least one player. The game utilizes at least one die presenting a plurality of values. The method includes the step of establishing a round for a player to roll the at least one die. At least one wager is received from at least one player. At least one die is randomized in an initial roll to ascertain an initial roll value. The method also includes awarding a payout of the wager to the at least one player and ending the round if the initial roll value matches an initial roll payout value. If the initial roll value does not match the initial roll payout value, then the initial roll value is set as a target number. A predetermined finite number of subsequent rolls of the at least one die is allowed if the initial roll value does not match the initial roll payout value. The method further includes randomizing the at least one die in at least one subsequent roll to ascertain at least one subsequent roll value. A payout of the wager is awarded and the round is ended if one of the subsequent roll values of the at least one die matches the target number. The method further includes ending the round without a payout if the predetermined finite number of subsequent rolls is exhausted before one of the subsequent roll values matches the target number.

Limiting the number of subsequent rolls decreases the likelihood of rolling the target number before the round ends. As a result, the payout odds for rolling the target number may be substantially higher over Craps and other dice games of the related art. These higher payout odds are attractive to many players and create an exciting gaming atmosphere.

Another aspect of the subject invention discloses a method of playing a dice game for wagering. The game utilizes at least two dice. The method includes the step of establishing a round for a player to roll the dice. At least one wager is received from at least one player. The dice are randomized in an initial roll prior to a target number being set to ascertain an initial roll value by summing the values presented on each die. The method also includes the steps of awarding a payout of the wager to the at least one player if the initial roll value matches the second most statistically likely roll value.

Providing a payout on the second most statistically likely roll provides an additional bonus that is not available in Craps and other dice games. Obviously, receiving the bonus in a wager game has the effect of increasing the satisfaction of players wagering on the game.

Yet another aspect of the subject invention discloses method of playing a dice game for wagering by at least one player utilizing a computer. The method includes the steps of establishing a round of play and receiving an input from at least one player representing a wager. At least one random number is generated by the computer to ascertain an initial roll value. A payout of the wager is awarded to the at least one player and the round is ended if the initial roll value matches an initial roll payout value. The method also includes setting the initial roll value as a target number if the initial roll value does not match the initial roll payout value. A predetermined finite number of subsequent rolls of the at least one die is allowed if the initial roll value does not match the initial roll payout value. The method further includes generating at least one random number to ascertain at least one subsequent roll value. A payout of the wager is awarded and the round is ended if one of the subsequent roll values matches the target number. The method also includes ending the round without a payout if the predetermined finite number of subsequent rolls is exhausted before one of the subsequent roll values matches the target number.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Referring to the Figures, wherein like numerals indicate like parts throughout the several views, a dice game for wagering is described herein. Specifically, a method of playing the dice game, a gaming table 10 for playing the dice game, and a computerized implementation of the dice game are described in detail. The dice game may be played by one or more players.

Figure 1:
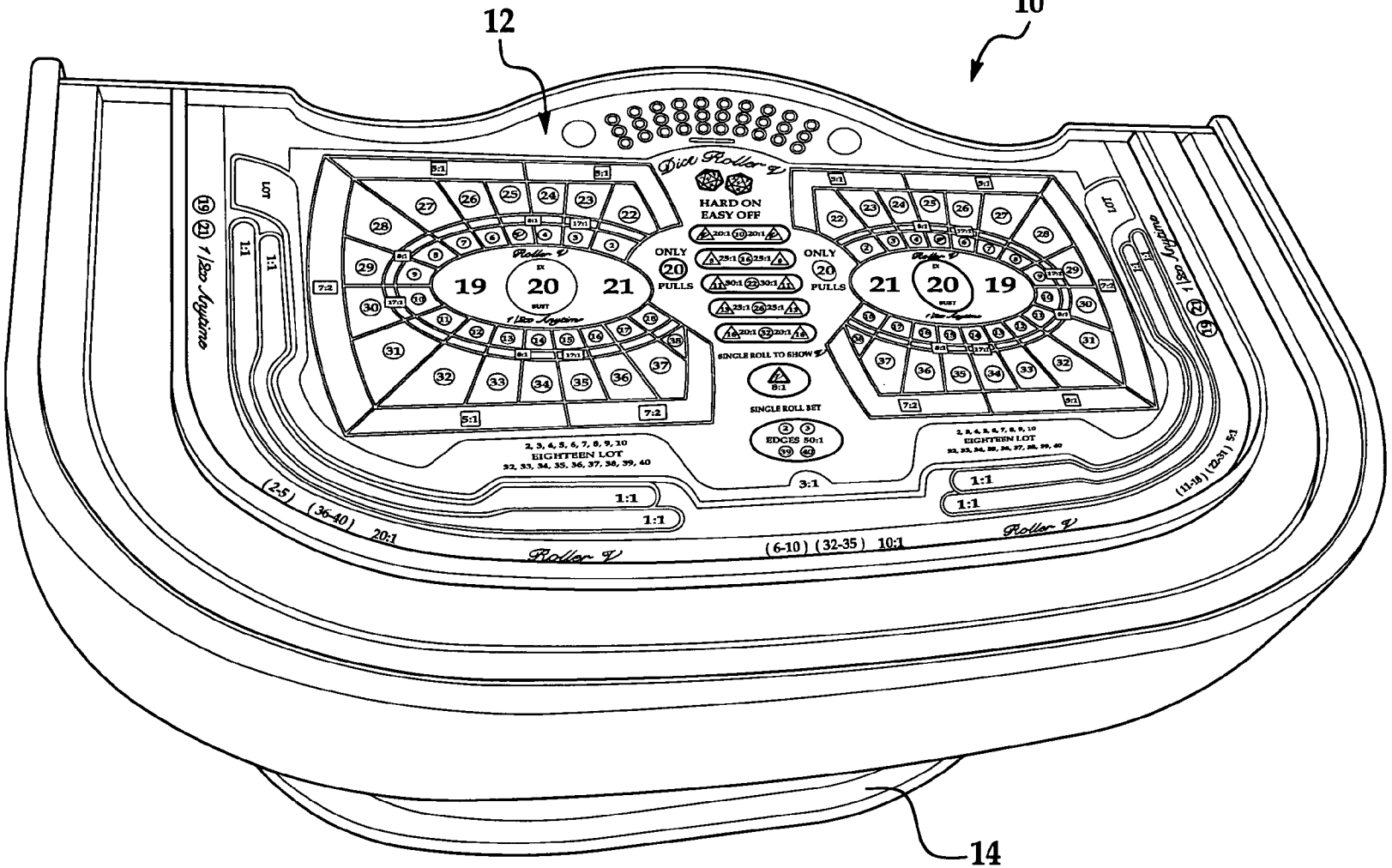
FIG. 1 is a perspective view of a gaming table of a first embodiment for playing the dice game according to the present invention.

In a first embodiment of the subject invention, the dice game is played on the gaming table 10, as alluded to above and shown in FIG. 1. The gaming table 10 may be used in a casino or other suitable location where "live action" wagering games are played. Typically, one or more table attendants operate the table 10. These table attendants are commonly referred to as dealers, stick-men, dice-men, or bankers.

Figure 2:
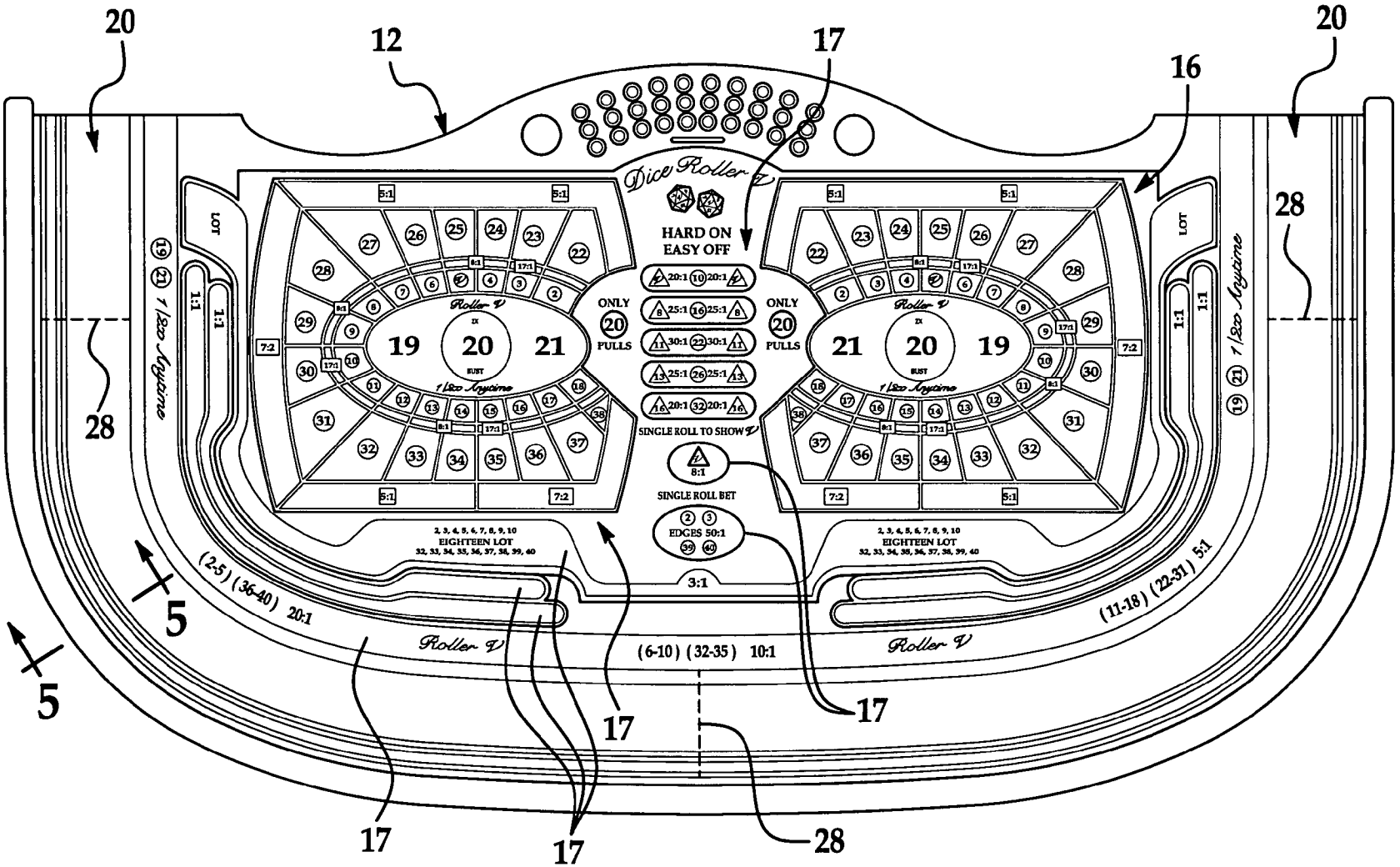
FIG. 2 is a top view of a tabletop of the gaming table of the first embodiment.

In the first embodiment, the gaming table 10 includes a tabletop 12 that is elevated off a floor (not numbered) by a pedestal 14 as is well known to those skilled in the art. Referring now to FIG. 2, the tabletop 12 of the first embodiment includes a wagering section 16. The wagering section 16 includes various wagering areas 17. Each wagering area 17 signifies one of the many wagers that are available in the illustrated embodiment of the dice game. Typically, each player will place one or more chips in the wagering area or areas corresponding to the wager (i.e., a bet) that the player wishes to make. Each chip denotes a monetary value, as is well known to those skilled in the art. In one embodiment, each player is assigned a unique chip color. This assists in identifying the owner of each chip and reduces theft and misunderstandings at the gaming table 10.

Figure 3:
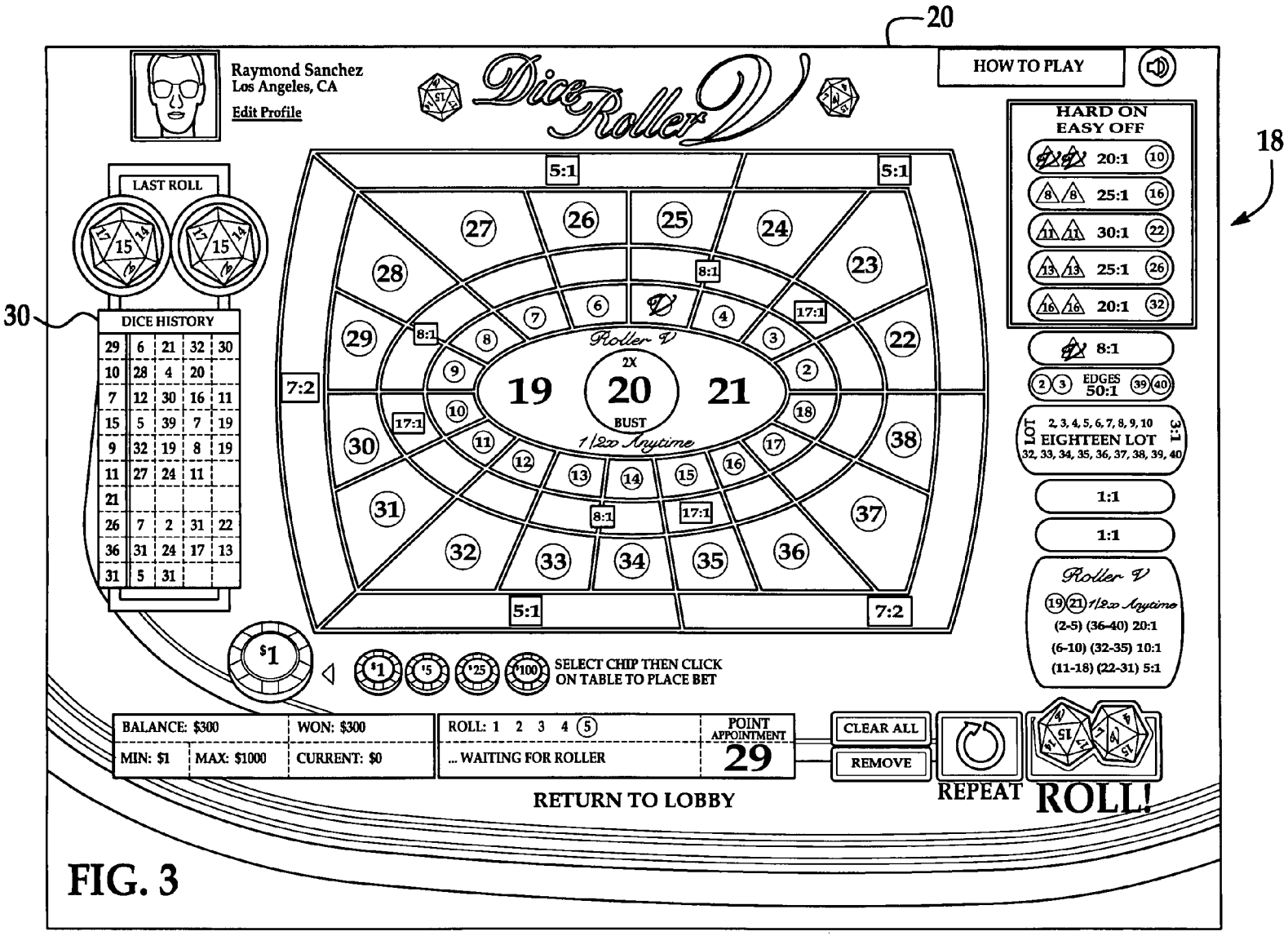
FIG. 3 is a screen image of a display of a computerized implementation of a second embodiment of the dice game.

In a second embodiment of the subject invention, the dice game is played on a computer (not shown). The player accesses the game via a user interface 18, as shown in FIG. 3. The user interface 18 may include a computer display 20 for visually presenting the game to the player as well as an input device (not shown) for receiving input, selections, and/or commands from the player. The user interface 18 may be disposed in a casino such as is common with other computerized wagering games, such as slot machines, video poker, etc. The user interface 18 may also be presented via a personal computer (not shown) in which the data is received over a network (not shown), such as the Internet. Accordingly, the player may participate in the dice game at a location distant from a casino or other gaming establishment. Furthermore, the user interface 18 may be distant from the computer in which the game is played, for instance as a web-based game.

The user interface 18 in the second embodiment may display a plurality of avatars, i.e., computer images that resemble actual humans. These avatars are shown surrounding a computer image of the gaming table 10 that is used in the first embodiment. The avatars simulate most aspects of "live" game play, such as rolling the dice, placing and collecting wagers, and interacting with fellow players.

The dice game of the subject invention utilizes at least one die. The at least one die presents a plurality of values. In the gaming table 10 implementation of the first embodiment, the at least one die is a physical object which can be rolled to randomly generate a value. However, the at least one die of the subject invention need not by a physical object. In the computerized implementation of the second embodiment, the at least one die is implemented electronically, e.g., with a random number generator algorithm that generates a random or pseudo-random number. However, the user interface 18 may provide a visual representation of the at least one die that appears to be a physical object. As such, the use of the term "at least one die" or "dice" in this application may refer to any means for randomly generating a number and should not be read as limiting to physical, rollable dice.

Figure 4:
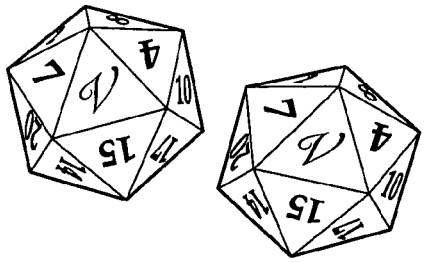
FIG. 4 is a perspective view of a pair of twenty-sided dice for use in the first embodiment the dice game.

In the illustrated embodiments, the dice game of the subject invention is played using two dies, i.e., a pair of dice. More specifically, in the illustrated embodiments, the dice game utilizes two twenty-sided dice, as shown in FIG. 4. The twenty-sided dice, also known as icosahedrons, have twenty triangularly shaped sides. Each side is numbered with a unique integer from 1 through 20. The value of each roll of the dice is achieved by summing the number shown on the upward facing face of each die. As such, the value of each roll ranges from 2 through 40.

In other embodiments, the dice game of the subject invention may be played using other dice configurations, such as, but not limited to, six-sided dice, ten-sided dice, and twelve-sided dice. Furthermore, the dice game may be played with one die or more than two dice. Also, the values on the sides of the die or dice may not be unique, i.e., some numbers may be repeated. For purposes of simplicity and clarity, the game will be described hereafter as utilizing the two twenty-sided dice. However, the use of this nomenclature should not be read as limiting the invention beyond the scope of the claims.

In the illustrated embodiments, as shown in various ways throughout the figures, the number "5" is replaced with a stylized roman numeral "V". However, this replacement is done for aesthetic and trade dress purposes only and is not essential to the play and operation of the game.

The dice are typically rolled by one of the players of the game. The opportunity to roll the dice is passed from player to player such that each player has a turn to roll the dice. However, players are not required to roll the dice and may simply pass their turn to another. Furthermore, it should also be appreciated that the dice may alternatively be rolled by the table attendant and/or by an automated mechanism (not shown).

In the first embodiment, as shown in FIGS. 1 and 2, the tabletop 12 also includes a dice trough 20 for isolating a roll of the dice from the wagering section 16. This isolation prevents interference of the dice with the chips placed in the various wagering areas of the wagering section 16. As such, confusion resulting from chips that are knocked from one wagering area to another wagering area is reduced when compared to prior art dice games where the dice are rolled in the same area where wagers are placed.

The dice trough 20 includes a bottom surface 22, an inner wall 24, and an outer wall 26. The inner and outer walls 24, 26 each extend upward from the bottom surface 22. The inner wall 24 is immediately adjacent to the wagering section 16 of the tabletop 12 and serves to isolate the trough 20 from the wagering section 16. The outer wall 26 is disposed around a periphery (not numbered) of the table 10. The players of the game are typically standing or seated around the periphery adjacent the outer wall 26 of the dice trough 20.

Figure 5:
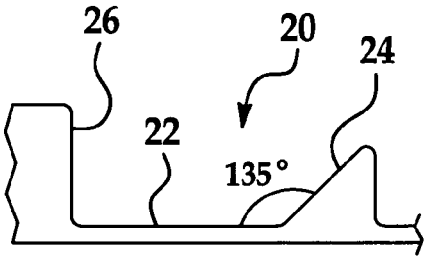
FIG. 5 is a cross-sectional view of a dice trough of the gaming table of the first embodiment.

In the first embodiment, the inner wall 24 is disposed non-perpendicular to the bottom surface 22 while the outer wall 26 is disposed generally perpendicular to the bottom surface 22. Specifically, as shown in FIG. 5, the inner wall 24 is disposed at about a 135° and to the bottom surface 22. This angled disposition of the inner wall 24 assists in assuring that the dice are sufficiently randomized when rolled through the trough 20.

In the first embodiment, at least one line 28 is displayed on the trough 20. Specifically, three lines 28 are utilized on trough as shown in FIGS. 1 and 2. These lines 28 may be used so that the dice have been sufficiently randomized. For instance, the casino operating the gaming table 10 may require that the dice pass by at least two of these lines 28 to ensure a sufficiently randomized roll.

As stated above, each player of the dice game of the subject invention is given a turn to roll the dice. Each turn of the player includes of at least one round of play and each round includes at least one roll of the dice. As such, the method of the subject invention includes the step of establishing a round for each player to roll the dice.

Prior to the roll of the dice, each player is afforded the opportunity to make a wager on the outcome of the roll of the dice. Accordingly, the method includes receiving at least one wager from at least one player. Various wagers may be available to the players of the game. These wagers include, but are not limited to, a primary bet and a plurality of secondary bets.

Play of the dice game is focused on the primary bet. The primary bet is also referred to as the "Roller V" bet. Accordingly, a primary bet wagering area on the tabletop is denoted "Roller V". However, the term "Roller V" is a trade name and does not affect the rules and method of game play. Furthermore, a player need not make a wager on the primary bet to make a wager on the other bets.

Each round of play includes an initial roll of the dice. That is, the dice are randomized in an initial roll to ascertain an initial roll value. A payout of the primary bet is awarded to each player if the initial roll value matches an initial roll payout value. The initial roll payout value includes the most statistically likely roll and the second most statistically likely roll. The "most statistically likely roll" refers to the roll value or values that will occur most often over a large number of rolls. The "second most statistically likely roll" refers to the roll value refers to the roll value or values that occur most often after the most statistically likely roll. In the illustrated embodiment, where two twenty-sided dice are used, the most statistically likely roll is 20 while the second most statistically likely roll is either 19 or 21.

In the illustrated embodiment, the payout for the most statistically likely roll is 2:1, i.e., the player is awarded twice the value that is wagered on the primary bet. The payout for the second most statistically likely roll is less than the payout for the most statistically likely roll. Specifically, in the illustrated embodiments, the payout for the second most statistically likely roll is 1:2. Said another way, the player is awarded a value half of what was wagered. For example, if fifty dollars were wagered on the primary bet and 20 was rolled during the initial roll, then one hundred dollars would be awarded to the player. If fifty dollars were wagered on the primary bet and a 21 was rolled during the initial roll, then twenty-five dollars would be awarded to the player.

If the initial roll value matches the initial roll payout value, then the round is ended. The next roll of the dice is another initial roll. However, this occurrence does not necessarily end the turn of the player to roll the dice. Instead, the player may continue to roll the dice until a turn ending outcome occurs, as is described below.

If the initial roll value does not match the initial roll payout value, then the initial roll value is set as a target number for subsequent rolls. This target number may also be referred to as the "point" or the "point appointment number". The target number is also marked on the tabletop using a token, dowel, or other identifying means such that the players (and table attendants) may be reminded what number is currently set as the target number. (Also, a display panel as described below and shown in FIG. 6 also serves to remind players of what the target number is.) As the round ends if 19, 20, or 21 are rolled, it follows that 19, 20, and 21 will never be set as the target number, as a new round begins after such a roll.

The dice game allows a predetermined finite number of subsequent rolls of the at least one die if the initial roll value does not match the initial roll payout value. Said another way, subsequent rolls, i.e., those rolls after the initial roll, are limited in number. In the illustrated embodiment, the predetermined finite number is four. However, the predetermined finite number may be any non-infinite integer in alternative embodiments.

In each subsequent roll, the dice are rolled, i.e., randomized, and a subsequent roll value is ascertained. A payout of the primary bet is awarded if one of the subsequent roll values of the dice matches the target number (i.e., the initial roll value). That is, a payout is awarded on the primary bet for "hitting the point". The amount of payout for hitting the target number varies based on the target number, due to the varying statistical probability of rolling the various target numbers. For instance, the chance of rolling 18 or 22 is much more likely than rolling 2 or 38; thus, the payout for rolling 2 or 40 is typically much higher than then payout for 18 or 22. Nevertheless, the payout for hitting the point is typically higher than 1:1 and more typically higher than 4:1. More specifically, in the illustrated embodiment, the payout for hitting a target value of 11-18 or 22-31 is 5:1, the payout for hitting a target value of 6-10 or 32-35 is 10:1, and the payout for hitting a target value of 2-5 or 36-40 is 20:1

A payout of the primary bet is also awarded whenever any of the subsequent roll values matches the second most statistically likely roll value. Specifically, in the illustrated embodiments, the payout for the second most statistically likely roll is 1:2. As such, the 1:2 payout of the primary bet is awarded at any time when the value of the roll is 19 or 21.

The round is ended if one of the subsequent roll values matches the target number. However, this occurrence does not end the turn of the player to roll the dice. Instead, the player rolling the dice is permitted to continue to roll the dice as this player is often considered "a hot shooter."

The round is ended without a payout if the predetermined finite number of subsequent rolls is exhausted before one of the subsequent roll values matches the initial roll value. That is, if the player rolling the dice fails to hit an initial payout value during the initial roll and fails to hit the target number in four subsequent rolls, then the round ends and the players turn is over. All target bets are surrendered, i.e., collected from the table, if the target is not rolled in the four subsequent rolls.

The round is also ended without a payout if one of the subsequent roll values matches the most statistically probably roll value. Therefore, in the illustrated embodiments, if a 20 is rolled in one of the four subsequent rolls before the target number is rolled, then the round ends. All target bets are surrendered if the target is not rolled in the four subsequent rolls.

Limiting the number of subsequent rolls decreases the likelihood of rolling the target number before the round ends. As a result, the payout odds for rolling the target number (hitting the point) may be substantially higher over Craps and other dice game implementations that are usually found in casinos. These higher payout odds are attractive to many players and create an exciting gaming atmosphere.

The primary bet may not be removed after initial roll of each round. That is, the primary bet must remain active for the subsequent rolls unless the target number is rolled in one of the subsequent rolls.

The turn ending outcome occurs whenever any roll value matches the most statistically likely value is rolled. In the illustrated embodiment, a player's turn ends, and that player passes the dice to the next player, when the player rolls a 20, whether or not that roll is the initial roll or one of the subsequent rolls.

Figure 6:
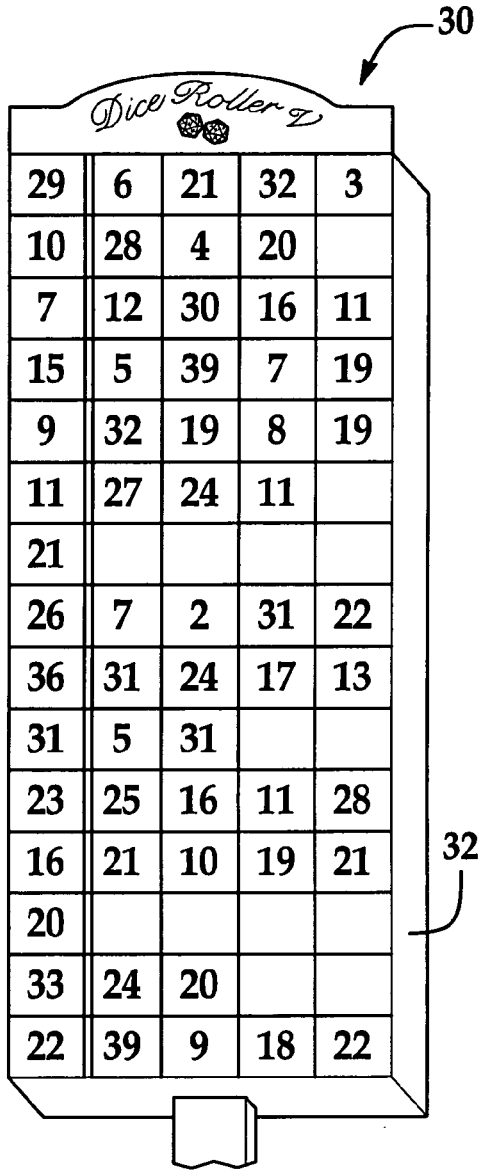
FIG. 6 is a front view of a display panel for use with the gaming table of the first embodiment.
Figure 7:
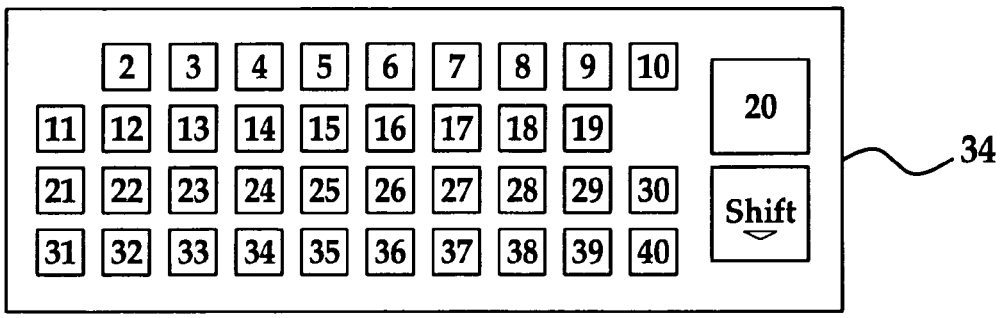
FIG. 7 is a front view of an input device for use with the gaming table of the first embodiment.

A chart 30 showing the various roll values may be provided in association with the dice game. In the first embodiment, as shown in FIG. 6, a display panel 32 is used to display the chart 30. In the second embodiment, as shown in FIG. 3, the chart 30 is shown on the computer display 20 of the user interface 18. The chart 30 includes a plurality of columns and rows. Each row represents a round of game play while each column represents a roll of the dice. The first (left-most) column represents the value of the various initial rolls (or point appointment rolls). Accordingly, the remaining four columns represent the value of the various subsequent rolls. In the first embodiment, the numbers may be input by one of the table attendants by utilizing a control panel 34, as shown in FIG. 7.

As stated above, and as can be seen in FIG. 2, numerous other wagers besides the primary bet are available in the dice game of the subject invention. These wagers are referred to herein as alternative bets. Each alternative bet may be made before or after any roll of the dice and are not contingent on the primary bet. Said another way, both the initial rolls or subsequent rolls may be utilized for the alternative bets.

A first alternative bet is referred to generally as a "placed number bet". The placed number bets are for one roll of the dice, i.e., the wager is surrendered if the payout is not made after a single roll. The dice game provides multiple placed number bets: a two-number bet, a four-number bet, a six-number bet, and an eight-number bet. In the illustrated embodiment, the numbers available for wagering in one of the placed number bets are predetermined and grouped together. In the illustrated embodiment, as can be seen in the wagering area layout of FIGS. 2 and 3, the numbers available for one of the place bets are grouped together as shown.

The two-number bet is allowed on the following pairs of numbers: 2 and 22, 3 and 23, 4 and 24, 5 and 25, 6 and 26, 7 and 27, 8 and 28, 9 and 29, 10 and 30, 11 and 31, 12 and 32, 13 and 33, 14 and 34, 15 and 35, 16 and 36, 17 and 37, and 18 and 38. A payout of 17:1 is awarded if the next roll of the dice produces a value equal to one of the numbers of the pair that is wagered on.

The four-number bet is allowed on a set of four numbers. These four numbers are two of the pairs of numbers of the two-number bet. More particularly, the two pairs of numbers are adjacent one another on the layout shown in FIGS. 2 and 3. Specifically, the sets of four numbers include 2, 3, 22, and 23; 3, 4, 23, and 24; 4, 5, 24 and 25; and so on, concluding with 17, 18, 37, and 38. A payout of 8:1 is awarded if the next roll of the dice produces a value equal to one of the four numbers of the set that is wagered on.

The six-number bet is available on the following sets of numbers: 2, 3, 4, 22, 23, and 24; 5, 6, 7, 25, 26, and 27; and 12, 13, 14, 32, 33, and 34. A payout of 5:1 is awarded if the next roll of the dice produces a value equal to one of the six numbers of the set that is wagered on. The eight-number bet is available on the following sets of numbers: 8, 9, 10, 11, 28, 29, 30, and 31 and 15, 16, 17, 18, 35, 36, 37, and 38. A payout of 7:2 is awarded if the next roll of the dice produces a value equal to one of the six numbers of the set that is wagered on.

A second alternative bet is referred to as a "color bet". With the second alternative bet, various numbers are assigned to either a first color or a second color. In the illustrated embodiments, the numbers 2, 3, 7, 8, 10, 13, 15, 16, 17, 19, 22, 25, 27, 30, 31, 33, 35, and 36 are assigned to the first color while 4, 5, 6, 9, 11, 12, 14, 18, 21, 23, 24, 26, 28, 29, 32, 34, 37, and 38 are assigned to the second color. The numbers 20, 39, and 40 are not assigned to a color. A payout of 1:1 is awarded if the next roll of the dice produces a value equal to one of the numbers of the color that is wagered on.

A third alternative bet is referred to as an "eighteen lot bet". In the third alternative bet, the eighteen numbers are assigned to a set. In the illustrated embodiments, the numbers are 2 through 10 and 32 through 40. If the next roll of the dice produces a value in this set, then a payout of 3:1 is awarded. However, if the roll does not produce a value in this set, then the wager is surrendered.

A fourth alternative bet is referred to as a "Hard On Easy Off" bet. A roll of the dice is referred to as a "hard" roll if the same number appears on each die and an "easy" roll if different numbers appear on each die. In this fourth alternative bet, a wager is made on whether a certain numerical value is achieved via a hard roll, i.e., where the same number appears on each die of the pair of dice. Specifically, in the dice game of the present invention, a payout is made on the fourth alternative bet if the certain numerical value is achieved in a hard roll before the certain numerical value is achieved on an easy roll or the most statistically likely roll is rolled. In the illustrated embodiment, the fourth alternative bet is available on the numerical values of 10, 16, 22, 26, and 32. The payout on a "hard 10" (two 5s) and a "hard 32" (two 16s) is 20:1, the payout on a "hard 16" (two 8s) and a "hard 26" (two 13s) is 25:1, and a payout on a "hard 22" (two 11s) is 30:1. The fourth alternative bet may be made or revoked before any roll and is not contingent on the primary bet. The wager on the fourth alternative bet is surrendered if an easy roll of the certain numerical value or a 20 occurs while the wager is active.

A fifth alternative bet is contingent on a single roll of the dice and is surrendered if no payout is awarded on the single roll. The fifth alternative bet awards a payout if a certain number is shown on either die of the pair of dies after the roll. Specifically, in the game of the illustrated embodiments, that certain number is limited to the number 5. However, in other embodiments, other numbers may be utilized. An 8:1 payout is made if the certain number is rolled on either of the dice.

A sixth alternative bet is referred to as an "edge" bet. The sixth alternative bet is contingent on a single roll of the dice and the wager is surrendered if no payout is awarded on the single roll. In the illustrated embodiment, a payout of 50:1 is awarded on the third proposition bet if a 2, 3, 39, or 40 are rolled.

INDUSTRIAL APPLICABILITY

The present invention may be further understood by reference to one specific embodiment of the game known as Dice Roller V™. The game is played on a purpose-built table with (2) twenty-sided dice (icosahedrons). The dice are made after very strict standards and are routinely examined for any damage. As a matter of course, the dice are replaced after approximately twelve hours of play. In the event that one or both dice are thrown off the table, they must be inspected before putting them back into play.

Players roll the dice within a designated trough along the inside perimeter of the Dice Roller V™ table. The trough has white-dotted lines that are shown at three equally spaced locations. Players are required to throw both dice past two of the white-dotted line spots in route to hitting the back wall. If they do not meet the requirement, the dealer (at their discretion) may deny the throw. Players must handle the dice with one hand only when throwing.

The Dice Roller V™ table can accommodate up to 12 players, who each get a turn of throws or a chance at 'shooting' the dice. If a player does not want to throw the dice, they may pass and bet on the thrower. Several types of bets can be made on the table action. The casino crew consists of two dealers and a center table boss.

Each player buys-in a different colored chip of their choice so bets don't get mixed up. At the end of play, if you won, you exchange back the colored chips and receive cash chips.

The first roll of the dice is called the Point Appointment Roll or "number get roll" or "get bet"—a new game in Dice Roller V™ begins with the Point Appointment roll. The Point Appointment Roll can be made only when the previous shooter fails to make a winning roll, that is, fails to make the Point, twenty out, or exhausts their five rolls . . . hence the name Dice Roller V™.

When the shooter fails to make his or her Point, the dice are then offered to the next player for a new Point Appointment Roll or "number get roll" or "get bet" and the game continues in the same manner. The new shooter is the person directly next to the left of the previous shooter—so the game moves in a clockwise fashion around the Dice Roller V™ table.

The Dice Roller V™ table is divided into three areas—two side areas separated by a center one. Each side area is the mirror reflection of the other and contains the following: Roller V bets, Placed Number bets, Color bets, and Eighteen Lot bets. The center area is shared by both side areas and contains the Proposition bets.

The layout of the Dice Roller V™ table gives players the option to make single roll bets, meaning after one roll players know if they won or lost, or multiple roll bets, where a number of rolls may be needed for players to win or lose their bet.

Each roller gets a chance to complete the Roller V bet (described below) and these bets keep on for between one and five consecutive dice rolls, depending on whether you win or not. Hence, the name Roller V bet. If a player wins the Roller V bet, they continue 'shooting' the dice until they lose the Roller V bet.

Below is a list of the various bets you can make in Dice Roller V:

Roller V Bet—These bets are for between one and five consecutive dice rolls. You win 2:1 if the first roll is a 20. If a point is established on the Point Appointment Roll (2-18, 22-40) it then must be repeated before the remaining four rolls have been exhausted or a 20 is thrown in order to win. The winnings vary and depend upon the Point Appointment Roll, since some numbers are naturally harder to roll than others. If a 20 is rolled before the point you lose. In addition, you win 1:2 if 19 or 21 are rolled at anytime during the Roller V Bet (1/2× Anytime). 19, 20, and 21 cannot be Point Appointment numbers. When you place a Roller V Bet, it cannot be picked up until all rolls have been completed and you have either won or lost the bet.

Placed Number Bet—These bets are for one dice roll only. You place your bet or bets on an interior yellow oval taking a minimum of two numbers in the table layout or on the outside. When everyone at the table has had a chance to place their bets, the dealer announces for the roller to throw the dice. From that moment no one is allowed to place or change his or her bet. Once there is a dice outcome, dealers place dowels on the winning numbers at both sides of the table, clear all the losing bets, and then pay the winning bets. The winners are those bets that are on or around the number that comes up. Also the bets on the outside of the layout win if the winning number is represented. Only after the dealers have paid the winning players and lifted the dowels can the next Placed Number Bet be made. The payouts consist of:

A two-number bet pays 17:1

A four-number bet pays 8:1

An outside six-number bet pays 5:1

An outside eight-number bet pays 7:2

Color Bet—These bets are for one dice roll only. You place your bet on either of the red or green bars. If the dice outcome matches your color and shows you have won, you are paid 1:1 on the bet. You must wait until the dealers have lifted their dowels before removing your winning Color Bet.

Eighteen Lot Bet—These bets are for one dice roll only. If a 2-10 or 32-40 is rolled you win 3:1 on the bet. If an 11-31 is rolled you lose. Again, you must wait until the dealers have lifted their dowels before removing your winning Eighteen Lot Bet.

Proposition Bets—These bets can be made or pulled at any time before the roll.

Hard On Easy Off: The bet wins if it's thrown hard (sum of pairs: 8-8, 11-11, 13-13 . . . ) before it's rolled easy or 20 is thrown. Payoffs: Hard 10 and 32, 20:1; Hard 16 and 26, 25:1; and Hard 22, 30:1. This is NOT a Roller V Bet.

Single Roll to Show V: This bet is for one roll only. The bet wins 8:1 if a V shows on either dice during a single roll.

Edges: The bet wins if a 2, 3, 39 or 40 is rolled: This bet is for one roll only. Payoff 50:1.

Roller V Bet—players look to throw a hot streak of rolls or seek the hot table where they can parlay their winnings into substantially larger winnings. Players take the dice and hit points or ride a 'hot roller' and benefit from their rolls. The odds on the Roller V Bet make this a very attractive bet, because when the table is hot and hitting points all players on the Roller V Bet are winning.

Placed Number Bet—players try to predict what number will hit. This isn't easy with luck playing an important part of the game. Players can bet on winning numbers calling them 'hot' numbers or on numbers that haven't come up for awhile believing their turn is due. Some players bet on many numbers to increase their chances of winning, but then payout is considerably reduced. Still other players use a methodical Dice Roller V system, money management system, or both.

Proposition Bet—players risk/reward is substantially increased here. The risk of the bet is offset by the amount that can be won on these bets.

The following table shows pays, probability, and house edge for each bet:

| BET | PAYS | PROBABILITY | HOUSE EDGE |
|---|---|---|---|
| Red | 1:1 | 47.25% | 5.5% |
| Green | 1:1 | 47.25% | 5.5% |
| Two Number Combo | 17:1 | 5% | 10% |
| Four Number Combo | 8:1 | 10% | 10% |
| Six Number Combo | 5:1 | 15% | 10% |
| Eight Number Combo | 3.5:1 | 20% | 10% |
| Hard 10 | 20:1 | 3.7% | 25% |
| Hard 16 | 25:1 | 3% | 23.53% |
| Hard 22 | 30:1 | 2.7% | 18.42% |
| Hard 26 | 25:1 | 3% | 23.53% |
| Hard 32 | 20:1 | 3.7% | 25% |
| Eighteen Lot | 3:1 | 22.5% | 10% |
| V - One Roll | 8:1 | 10% | 10% |
| Edges (2, 3, 39, 40) | 50:1 | .75% | 24.25% |
| Roller V (2-18)(22-40) | 5:1 10:1 20:1 | --- | 0%-50% |

The present invention has been described herein in an illustrative manner, and it is to be understood that the terminology that has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A method of playing a dice game for wagering by at least one player, the game utilizing at least one die presenting a plurality of values, said method comprising the steps of:

establishing a round for a player to roll the at least one die;

receiving at least one wager from at least one player;

randomizing the at least one die in an initial roll to ascertain an initial roll value;

awarding a payout of the wager to the at least one player and ending the round if the initial roll value matches an initial roll payout value;

setting the initial roll value as a target number if the initial roll value does not match the initial roll payout value;

allowing a predetermined finite number of subsequent rolls of the at least one die if the initial roll value does not match the initial roll payout value;

randomizing the at least one die in at least one subsequent roll to ascertain at least one subsequent roll value;

awarding a payout of the wager and ending the round if one of the subsequent roll values of the at least one die matches the target number; and ending the round without a payout if the predetermined finite number of subsequent rolls is exhausted before one of the subsequent roll values matches the target number.

2. A method as set forth in claim 1 wherein the at least one die is a plurality of dice and the initial roll value and the subsequent roll values are each determined by summing the value presented on each die.

3. A method as set forth in claim 2 wherein each die has twenty sides and provides twenty unique values.

4. A method as set forth in claim 3 wherein the twenty unique values are integers from 1 through 20.

5. A method as set forth in claim 2 wherein each die has eight sides and provides eight unique integer values from 1 through 8

6. A method as set forth in claim 1 wherein the initial roll payout values includes the most statistically likely roll and the second most statistically likely roll.

7. A method as set forth in claim 6 wherein each die has twenty sides to provide twenty unique integer values from 1 through 20.

8. A method as set forth in claim 7 wherein the most statistically likely roll value is 20 and the second most statistically likely roll value is 19 or 21.

9. A method as set forth in claim 1 further comprising the step of awarding a payout of the wager to the at least one player if the initial roll value or any of the subsequent roll values matches the second most statistically likely roll value.

10. A method as set forth in claim 1 wherein the predetermined finite number of subsequent rolls equals four.

11. A method of playing a dice game for wagering, the game utilizing at least two dice, said method comprising the steps of:

establishing a round for a player to roll the dice;

receiving at least one wager from at least one player;

randomizing the dice in an initial roll prior to a target number being set to ascertain an initial roll value by summing the values presented on each die;

awarding a payout of the wager to the at least one player if the initial roll value matches the second most statistically likely roll value.

12. A method as set forth in claim 11 wherein each die has twenty sides to provide twenty unique values from 1 through 20 and the second most statistically likely roll value is 19 or 21.

13. A method as set forth in claim 11 wherein the payout is less than the amount of the wager.

14. A method as set forth in claim 11 wherein the payout is ½ of the wager.

15. A method of playing a dice game for wagering, the game utilizing at least two dice, said method comprising the steps of:

establishing a round for a player to roll the dice;

receiving at least one wager from at least one player;

randomizing the dice in an initial roll prior to a target number being set to ascertain an initial roll value by summing the values presented on each die;

awarding a payout of the wager to the at least one player if the initial roll value matches the second most statistically likely roll value; and randomizing the dice in at least one subsequent roll to ascertain at least one subsequent roll value by summing the values presented on each die.

16. A method as set forth in claim 15 further comprising the step of awarding a payout of the wager to the at least one player if the at least one subsequent roll value matches the second most statistically likely roll value.

17. A method as set forth in claim 11 wherein each die has twelve sides to provide twelve unique integer values from 1 through 12 and the second most statistically likely roll value is 11 or 13.

18. A method of playing a dice game for wagering by at least one player utilizing a computer, said method comprising the steps of:

establishing a round of play;

receiving an input from at least one player representing a wager;

generating at least one random number with the computer to ascertain an initial roll value;

awarding a payout of the wager to the at least one player and ending the round if the initial roll value matches an initial roll payout value;

setting the initial roll value as a target number if the initial roll value does not match the initial roll payout value;

allowing a predetermined finite number of subsequent rolls of the at least one die if the initial roll value does not match the initial roll payout value;

generating at least one random number with the computer to ascertain at least one subsequent roll value;

awarding a payout of the wager and ending the round if one of the subsequent roll values matches the target number; and ending the round without a payout if the predetermined finite number of subsequent rolls is exhausted before one of the subsequent roll values matches the target number.

19. A method as set forth in claim 18 wherein generating at least one random number is further defined as generating a first random integer, generating a second random integer, and summing the first and second random integers to arrive at a random number.

20. A method as set forth in claim 19 wherein the first random integer is from 1 through 20, the second random integer is from 1 through 20, and the random number is from 2 through 40.

21. A method of playing a dice game for wagering by at least one player, the game utilizing a pair of twenty-sided dice wherein the dice each provide twenty unique values from 1 through 20, said method comprising the steps of:

establishing a round for a player to roll the dice;

receiving at least one wager from at least one player;

randomizing the dice in an initial roll;

ascertaining an initial roll value by summing the value presented on each of the dice of the initial roll;

awarding a 2:1 payout of the wager to the at least one player and ending the round if the initial roll value is 20;

awarding a 1:2 payout of the wager to the at least one player and ending the round if the initial roll value is 19 or 21;

setting the initial roll value as a target number and allowing four subsequent rolls of the dice if the initial roll value is not 19, 20, or 21;

randomizing the dice in at least one subsequent roll;

ascertaining at least one subsequent roll value by summing the value presented on each of the dice of the at least one subsequent roll;

awarding a payout of the wager and ending the round if the at least one subsequent roll value matches the target number; and ending the round without a payout if the four subsequent rolls are exhausted before a payout or if the at least one subsequent roll value is 20.

22. A method as set forth in claim 15, including the step of awarding a different payout of the wager to the at least one player if the initial roll value matches the first most statistically likely roll value.

* * * * *